US007083156B2

(12) United States Patent
Jost et al.

(10) Patent No.: US 7,083,156 B2
(45) Date of Patent: Aug. 1, 2006

(54) AUTOMATIC PROXIMITY FAUCET WITH OVERRIDE CONTROL SYSTEM AND METHOD

(75) Inventors: George J. Jost, Lake in the Hills, IL (US); Sean Bellinger, Kenosha, WI (US); Jerry McDermott, Lake Bluff, IL (US); Aharon Carmel, Kibbutz Glil-yam (IL)

(73) Assignee: Technical Concepts, LLC, Mundelein, IL (US)

( * ) Notice: Subject to any disclaimer, the term of this patent is extended or adjusted under 35 U.S.C. 154(b) by 0 days.

(21) Appl. No.: 10/757,839

(22) Filed: Jan. 14, 2004

(65) Prior Publication Data

US 2004/0143898 A1 Jul. 29, 2004

Related U.S. Application Data

(60) Provisional application No. 60/441,091, filed on Jan. 16, 2003.

(51) Int. Cl.
*F16K 31/12* (2006.01)

(52) U.S. Cl. ..... 251/30.02; 251/285

(58) Field of Classification Search .. 251/30.01–30.05, 251/129.04, 89, 285, 129.11
See application file for complete search history.

(56) References Cited

U.S. PATENT DOCUMENTS

| | | | | | |
|---|---|---|---|---|---|
| 4,762,273 | A * | 8/1988 | Gregory et al. | ..... | 251/129.04 |
| 4,788,998 | A * | 12/1988 | Pepper et al. | ..... | 251/129.04 |
| 4,886,207 | A * | 12/1989 | Lee et al. | ..... | 251/30.01 |
| 4,995,585 | A * | 2/1991 | Gruber et al. | ..... | 251/30.03 |
| 5,244,179 | A * | 9/1993 | Wilson | ..... | 251/30.03 |
| 5,427,350 | A * | 6/1995 | Rinkewich | ..... | 251/30.01 |
| 5,549,273 | A * | 8/1996 | Aharon | ..... | 251/30.05 |
| 5,566,702 | A | 10/1996 | Philipp | | |
| 5,730,165 | A | 3/1998 | Philipp | | |
| 6,202,980 | B1 * | 3/2001 | Vincent et al. | ..... | 251/129.04 |
| 6,363,549 | B1 * | 4/2002 | Humpert et al. | ..... | 251/129.04 |

* cited by examiner

*Primary Examiner*—John Bastianelli
(74) *Attorney, Agent, or Firm*—Brinks Hofer Gilson & Lione

(57) ABSTRACT

A hands-free device includes a sensor, a motor, a pilot valve, a gear train, an arm, and, an override control. The pilot motor opens the pilot valve when an activation signal is received from the sensor. The arm is coupled to the gear train, and the override control is coupled to the arm. The override control is capable of moving the arm between a locked and unlocked configuration.

9 Claims, 9 Drawing Sheets

AUTOMATIC PROXIMITY FAUCET WITH OVERRIDE CONTROL SYSTEM AND METHOD

This application claims the benefit of U.S. Provisional Application No. 60/441,091, filed Jan. 16, 2003.

FIELD OF THE INVENTION

This invention relates to a system and a method that controls fluid flow, and more particularly, to a system and a method that controls fluid flow through a faucet.

BACKGROUND

Some faucets suffer from the effects of cross-contamination. The transfer of germs from one user to another can occur when a user touches a handle that enables the flow of water. Cross-contamination may result from hand-to-mouth, hand-to-nose, and hand-to-eye contact. An awareness of such contamination can create a reluctance to touch a fixture, which does not promote or preserve good hygiene.

To minimize the risk of transferring germs, some faucets use hands-free methods to control water flow. In these systems a passive sensor is used to detect a user. Once a user is detected, water flows for a fixed period of time.

A problem with some hands-free faucets is their inability to be turned on or off or to sustain a continuous water flow when a user is not detected. Because all sources of water possess naturally occurring contaminants, sometimes it is necessary to flush faucets and waterlines. Requiring a user to stand in front of a spout to flush a hands-free faucet can be time consuming and costly. The short periods of time that these hands-free faucets allow continuous water flow can also be inadequate as short periods of uninterrupted water flow will not always purge faucets of contaminants. Ironically, some automatic faucets used to prevent the spread of germs are more difficult to purge of water borne bacteria because a user is required to normally cause flow.

SUMMARY

The present invention is defined by the following claims. This description summarizes some aspects of the presently preferred embodiments and should not be used to limit the claims.

A hands-free embodiment comprises a sensor, a motor a pilot valve, a gear train, an arm, and an override control. Preferably, the motor opens the pilot valve when an activation signal is received from the sensor. Preferably, the arm is coupled to the gear train, and the override control is coupled to the arm. In one embodiment, the override control is capable of moving the arm between a locked and unlocked configuration.

Further aspects and advantages of the invention are described below in conjunction with the presently preferred embodiments.

DETAILED DESCRIPTION OF THE PRESENTLY PREFERRED EMBODIMENTS

The presently preferred system and method provide users with a hands-free system and method for controlling fluid flow through a spout. The preferred system and method allows for continuous flow without actuating a handle or a button. In one embodiment an override control can turn on a faucet and/or sustain a continuous flow even when a user is not detected. A continuous flow through a spout will flush a faucet and can eliminate contaminants.

Figure 1:
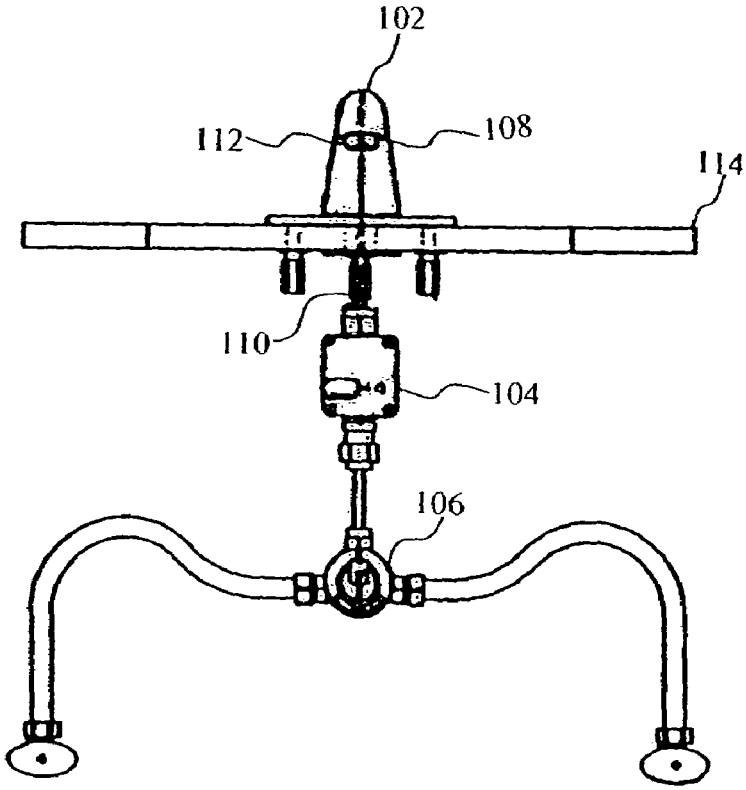
FIG. 1 is a front view of a hands-free embodiment.

FIG. 1 shows a front view of a hands-free embodiment. The embodiment comprises a spout 102, a valve housing 104, and a mixing housing 106. Preferably, the spout 102 directs and/or regulates the flow of a fluid from a reservoir such as a pipe or a drum. The mixing housing 106, positioned below the spout 102, includes multiple fitting illustrated as male compression fitting emanating from about the nine, twelve, and three o'clock positions of the mixing housing 106.

Preferably, the hands-free embodiment includes a sensor. When the sensor detects a user, an activation signal initiates continuous fluid flow. When the sensor no longer detects a user, the hands-free embodiment shuts off fluid flow which reduces the possibility of accidental flooding when the hand-free system and method are not in an open mode.

As shown in FIG. 1, the spout also comprises the sensor 108. The sensor 108 can be a proximity, motion, an infrared, or a body heat sensor, and/or any other device that detects or measures something by converting one form of energy into another (e.g., into an electrical or an optical energy, for example). Preferably, the sensitivity range of the sensor 108 is adjustable. In one embodiment, the sensor 108 comprises logic that conditions the activation signal and automatically adjusts to its surroundings. In this embodiment, the sensor 108 can compensate for changes in its environment including changes in humidity, temperature or contact with objects such as wet paper towels, for example, and still maintain a desired sensitivity. Although the illustrated sensor 108 also functions as a spout 102, the sensor 108 can be a separate element positioned adjacent to or away from the spout 102.

Figure 3:
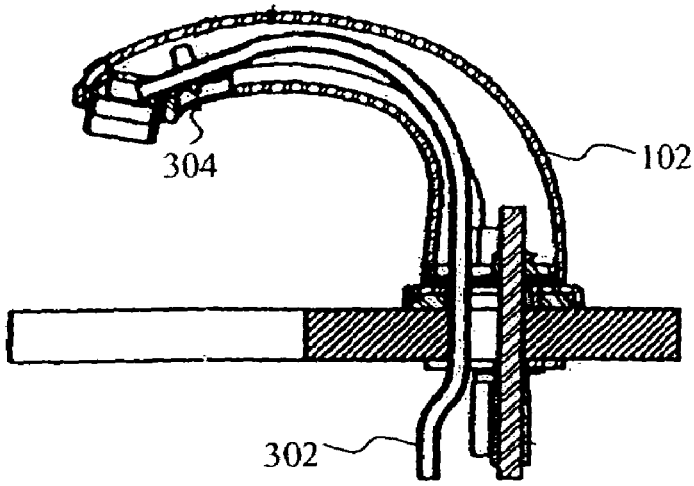
FIG. 3 is a partial cutaway view of an alternative spout mounted to a surface in FIG. 1.

Preferably, an outlet 110 couples the valve housing 104 to the spout 102. As shown in FIGS. 1 and 3, at one end an aerator 112 is threaded to the spout 102. The aerator 112 maintains fluid pressure by mixing air into the fluid. At another end, a threaded fitting couples the spout 102 to a surface 114. In this embodiment, the spout 102 can have many shapes. Besides the rectangular and circular cross-sections that are shown, the spout 102 encompasses many other designs that vary by shape, height, accessories (e.g., use of built in or attachable filters, for example), color, etc.

Figure 2:
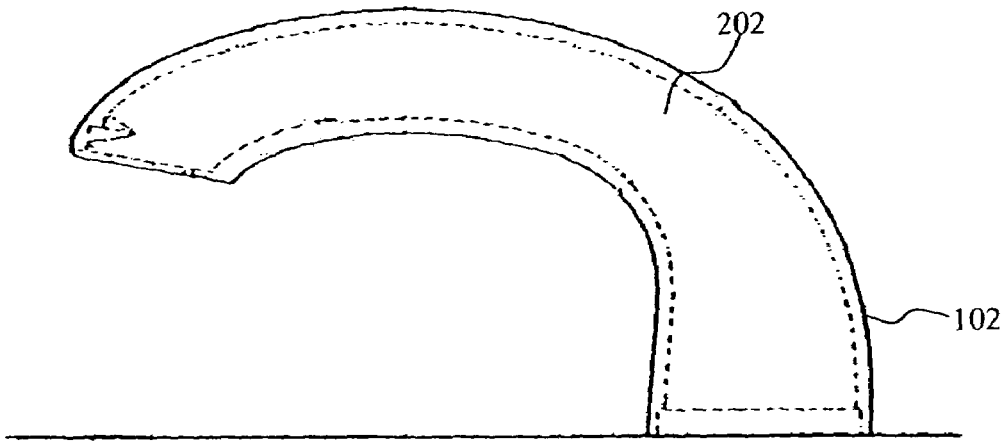
FIG. 2 is a partial cutaway view of a spout mounted to a surface in FIG. 1.

Preferably, there is little resistance to the flow of fluids through the spout 102. As shown in FIG. 2, fluid can flow through the entire interior volume 202 of the spout 102. In an alternative embodiment, fluid can flow through a portion of the spout 102. As shown in FIG. 3, fluid flow is restricted to a pipe 302 such as a copper tube or rubber hose enclosed by the spout 102. Preferably, a spout bracket 304 couples the pipe 302 to the spout 102. The spout bracket 304 can form a portion of the lower arcuate surface of the spout 102.

Figure 4:
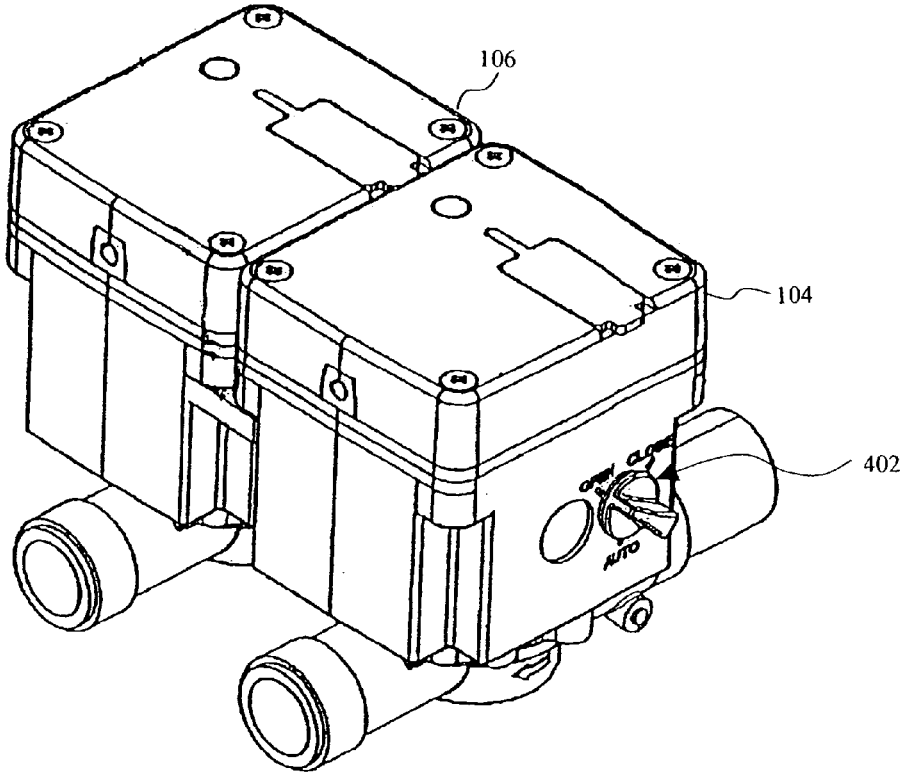
FIG. 4 is a top perspective view of a dual valve housing.
Figure 5:
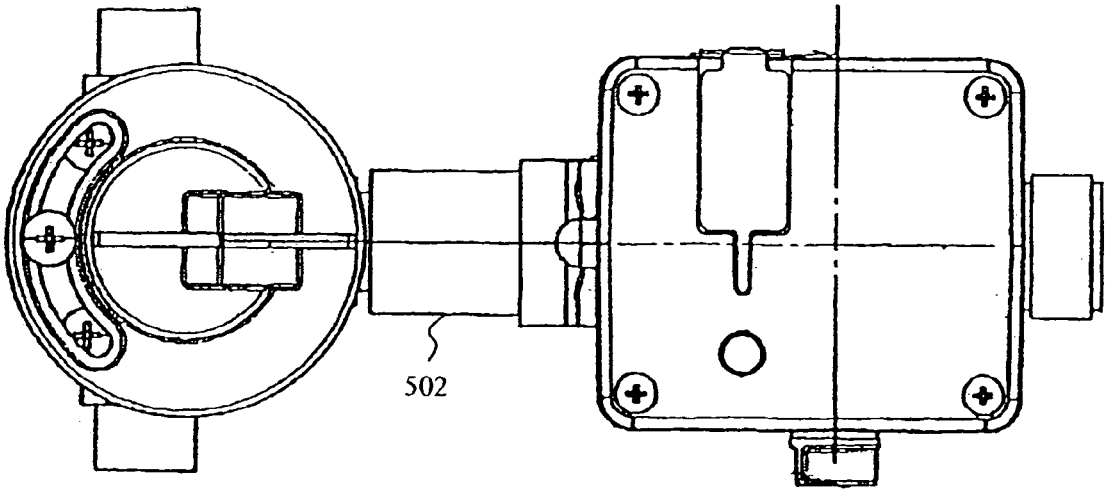
FIG. 5 is a top perspective view of an alternative mixing and valve housing.
Figure 6:
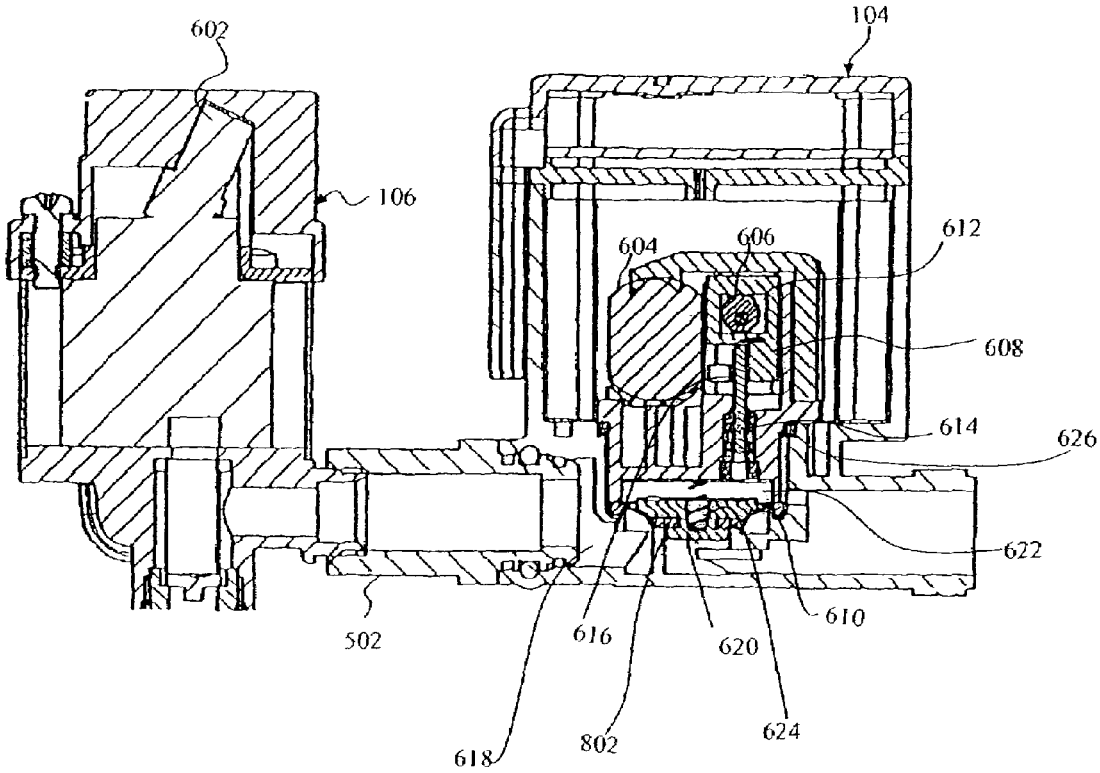
FIG. 6 is a front cutaway view of the mixing and valve housing taken along line I—I in FIG. 5.

Referring to FIGS. 4–6, the valve and mixing housing 104 and 106 can comprise a unitary housing or separate housing assemblies joined by straps and secured by the cover screws. Preferably, an override control 402 is coupled to the valve housing 104. In one embodiment, the override control 402 is a mechanism that activates and/or sustains fluid flow. In another embodiment, the override control is a mechanism or logic that can activate or prevent fluid flow, and/or allow continuous fluid flow beyond a predetermined or programmed period initiated by an output of the sensor 108.

Preferably, the mixing housing 106 encloses a mixing valve 602. Preferably, the mixing valve 602 blends fluids from more than one source. In this embodiment, hot and cold water are blended to a pre-set temperature. Although no adjustments are shown, some embodiments allow a user to preset, or adjust, the temperature of the water being dispensed from the spout 102.

Figure 7:
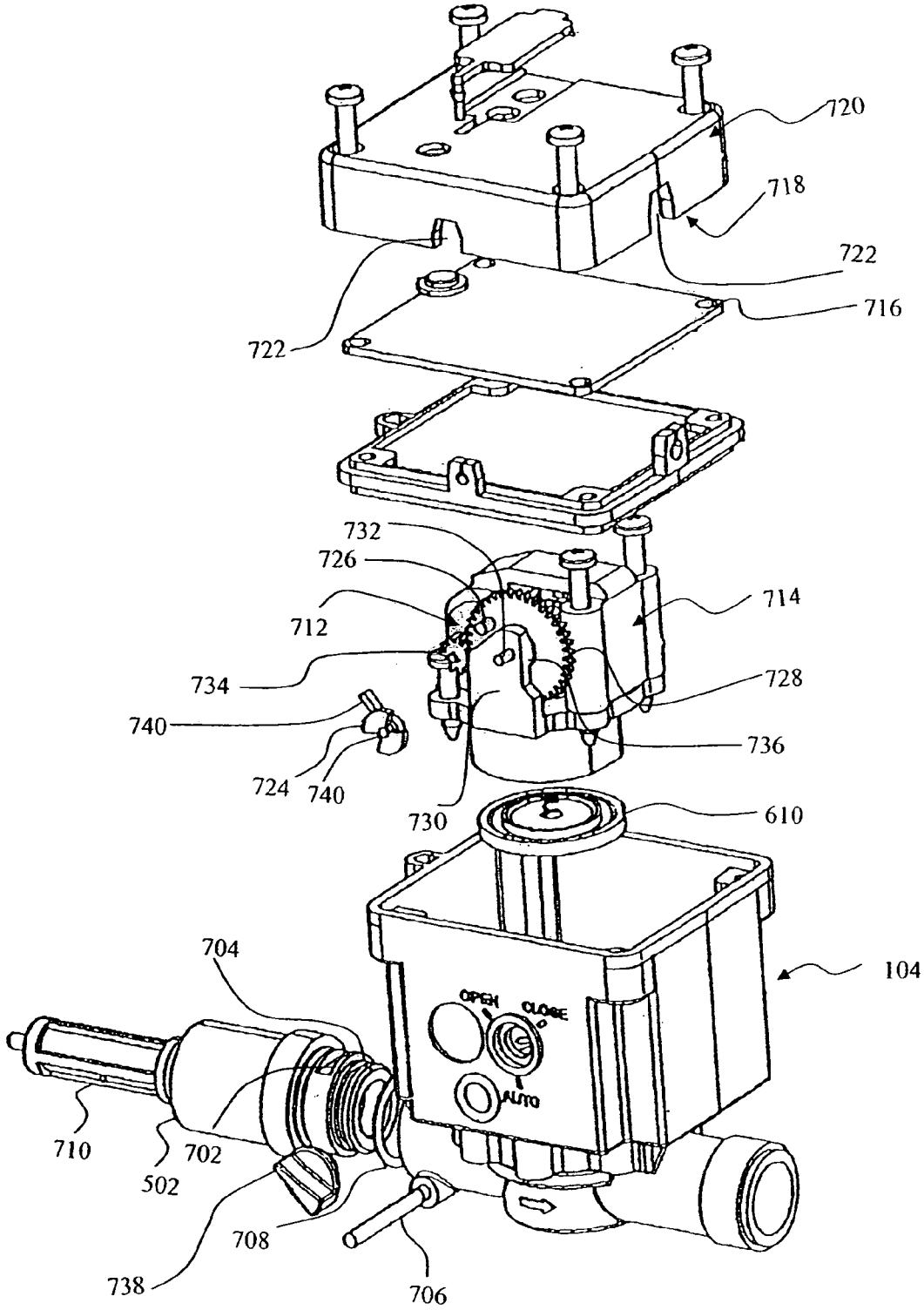
FIG. 7 is a top exploded view of a valve assembly.

Preferably, the mixing housing 106 is coupled to the valve housing 104 by a valve adapter 502. As shown, the valve adapter 502 comprises a cylinder having a keyway 702 and threads 704 at one end as shown in FIG. 7. When secured to the valve housing 104, a valve pin 706 seats within the keyway 702 providing a seal between the valve housing 104 and the valve adapter 502. An O-ring 708 preferably provides a positive fluid tight seal between the valve housing 104 and the valve adapter 502. An axial filter 710 can be disposed within the valve plug 502 to separate fluids from particulate matter flowing from the mixing valve 602 to the valve housing 104 or valve assembly. The filter 710 shown in figure 7 comprises a mesh or a semi-permeable membrane. In another embodiment other materials that selectively pass fluids without passing some or all contaminants can be used as a filter.

As shown in FIG. 6, the valve housing 104 encloses a motor 604. Preferably, the motor 604 is mechanically coupled to a cam 606. In this illustration, the cam 606 is the multiply curved wheel mounted to the motor 604 through a shaft and gear train 712. Preferably, the cam 606 and a cam follower 608 translate the rotational motion of the shaft into a substantially linear displacement that opens and closes a diaphragm 610. In this embodiment the cam 606 has an offset pivot that produces a variable or reciprocating motion within a cutout portion 612 of the cam follower 608. The cam follower 608 shown in the "P-shaped" cross-section is moved by the cam within an orifice, which engages a rod like element. Preferably, the rod like element comprises a pilot 614 that slides through an orifice 616. Movement of the pilot 614 can break the closure between the inlet 618 and the outlet port 620 by moving the diaphragm 610.

A bias plate 622 couples the diaphragm 610 to the pilot 614. The bias plate 622 illustrated in a rectangular cross-section with projecting legs at its ends distributes the axial pressure of the pilot 614 across an inlet surface of the diaphragm 610. Preferably, the diaphragm 610 is coupled between the legs of the bias plate 622 by a connector 624. In this embodiment the connector 624 comprises a threaded member. In another embodiment the connector 624 comprises an adhesive or a fastener.

Figure 8:
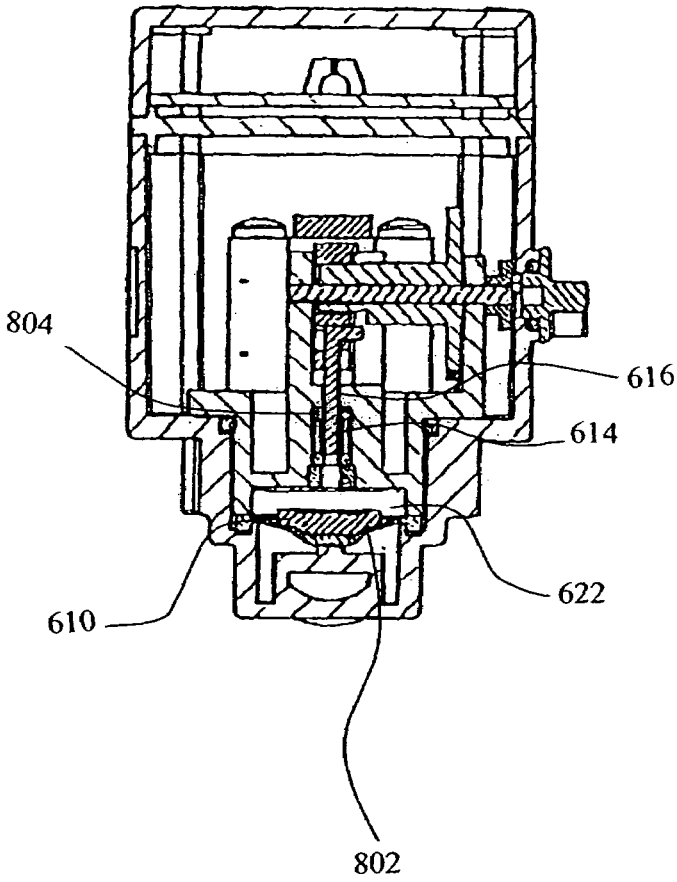
FIG. 8 is a partial side cutaway view of FIG. 7.

As shown in FIGS. 6 and 8, when the valve mechanism is closed, the diaphragm 610 seats against a seating ring or seating surface 802 which seals the inlet port 618 from an outlet port 620. When closed, the fluid and the pilot 614 exert a positive pressure against the diaphragm 610 which assures a fluid tight seal. When the pilot pressure is released the fluid pressure acting on the underside of the diaphragm 610 exceeds the seating pressure of the fluid pressing against the inlet surface of the diaphragm 610. When the pressure is greater on the underside than that on the inlet side, the diaphragm 610 is forced up which opens the valve and allows for a continuous angled fluid flow. When a pilot pressure is re-exerted, a fluid backpressure builds up on the inlet surface of the diaphragm 610. Preferably, the pilot and fluid backpressure force the diaphragm 610 to seat, which in turn, stops the flow. The build up of backpressure preferably occurs after the sensor no longer senses an appendage such as a hand, when the hands-free embodiment is in an automatic mode.

As shown in FIGS. 6 and 8, the diaphragm 610, which is the part of a valve mechanism that opens or closes the outlet port 622, is wedge shaped. Some diaphragms 610, however, can have a uniform thickness throughout or have many other shapes depending on the contour of the seating surface.

FIG. 7 shows a top exploded view of the valve assembly. A housing 104 encloses a pilot valve assembly 714 and logic 716. In this embodiment, the logic 716 interfaces the sensor 108 to the motor 604. A compression of a molding 718 that outlines the lower edges of the housing cover 720 causes a fluid tight seal to form around the inner and outer edges of the housing 104. Preferably, orifices 722 passing through the sides of the housing cover 720 allow power to be sourced to the logic 716 and the motor 604. While battery packs can provide the primary power in this embodiment, hardwired alternatives with or without battery backups can also be used. Preferably, low-voltage direct current power supplies or battery packs drive a Direct Current motor and the logic.

The pilot assembly 714 of the hands-free embodiment shown in FIG. 7 is preferably comprised of the motor 604, its shaft, the cam 606, the cam follower 608, the gear train 712, and the pilot 614. Preferably, the O-ring 626 shown in FIG. 6 makes a fluid tight seal between the motor 664, its shaft, the cam 606, cam follower 608, the gear train 712 and a portion of the pilot 614. Preferably, the seal is located approximately three quarters down the length of the pilot valve assembly 714.

Preferably, the hands-free embodiment also includes an override control 402 that allows for continuous fluid flow. The override control 402 shown in FIG. 7 is comprised of an override arm 724. The override arm 724 is fitted to a stem 726 comprised of a cylindrical projection connected to an outward face of one of the interconnected gears that form the gear train 712. In this embodiment, the stem 726 is a part of a spur gear 728 having teeth radially arrayed on its rim parallel to its axis of rotation.

Preferably, a strike plate 730 is coupled to the spur gear 728 by a shaft 732 that transmits power through the gear train 712 to the pilot 614. As shown, the strike plate 730 can interrupt the rotation of the shaft 732 and gear train 712 when the pilot 614 reaches a top or a bottom limit of travel. Preferably, contact between the stem 726 and the convex surfaces of the strike plate 730 establish the top and bottom limits of travel. At one end, the stem 726 strikes a positive moderate sloping side surface 734 of the strike plate 730 and at another end the stem 726 strikes a substantially linear side surface 736.

Preferably, an override knob 738 shown in figure 7 is coupled to an override shaft 724 projecting from the override arm. In this embodiment, when the override knob 738 is turned counter-clockwise, the gear train 712 rotates until a projection 740 on the override arm 724 strikes stem 726 the strike plate 730. In this position, the pressure on the underside of the diaphragm 610 will be greater than that on the inlet side, and the valve will be open.

While some embodiments encompass only an open and an automatic mode, FIG. 7 shows a hands-free embodiment that also encompasses a closed mode. In this mode, the valve is closed and the motor 604 will not respond to the sensor 108. While such a control has many configurations, in one embodiment this control can be an interruption of the ground or power source to the motor 604 by the opening of an electronic, mechanical, and/or an electro-mechanical switch. Only a turning of the override knob 738 to the automatic or open mode will allow fluid to flow through the outlet port 620.

Figure 9:
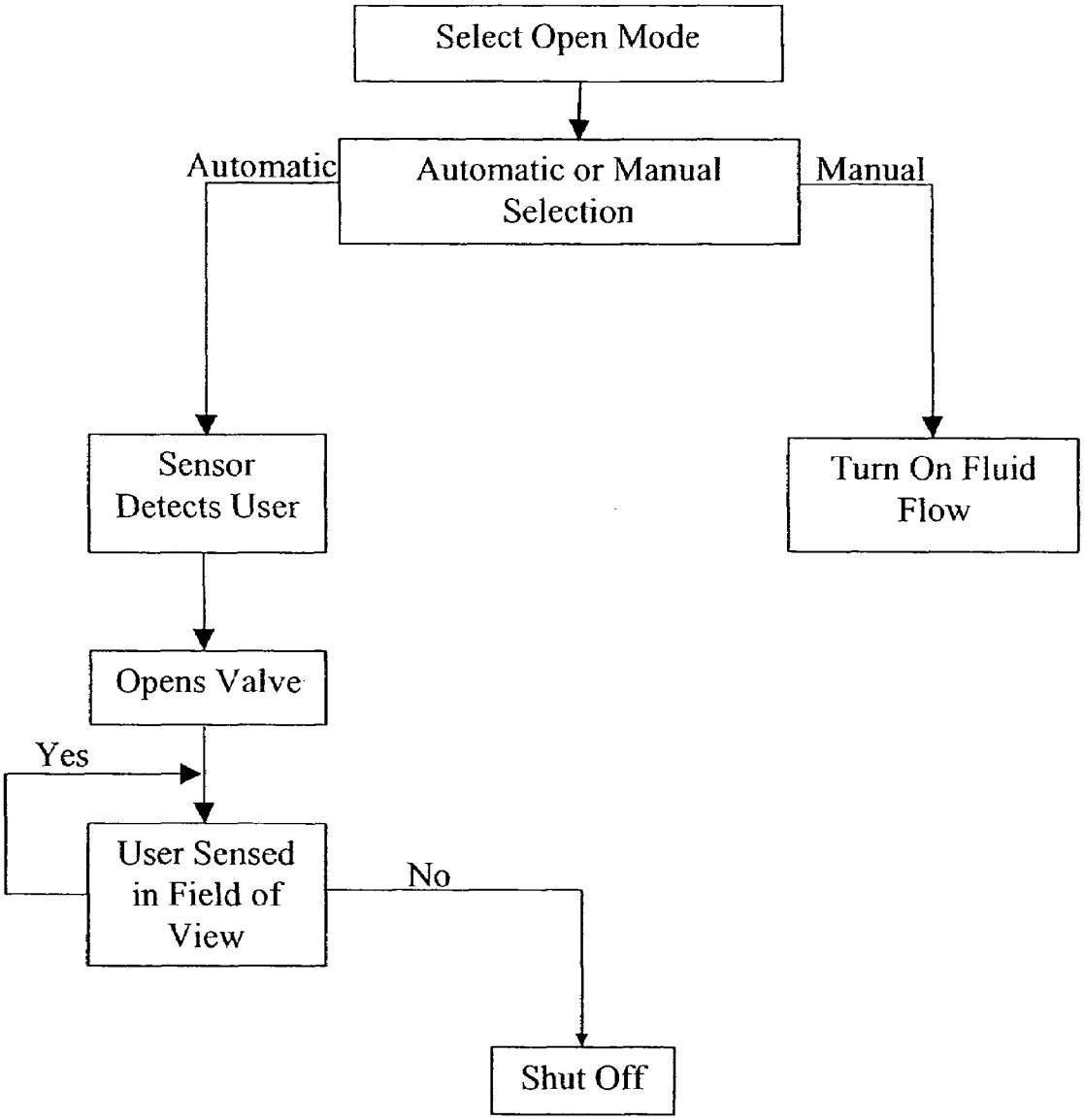
FIG. 9 is a flow diagram of a manual override method.

As shown in FIG. 9, the operation of the open mode begins when an open selection is made at act 902. Once selected, fluid flows unaffected by any pre-set or predetermined periods of time. Fluid flow is shut off by either an automatic or manual selection at act 904. In a manual mode, the detection of a user biases the motor to rotate the gear train 712 which is already in an open position. When a user is no longer detected, the motor rotates the gear train 712 and the override knob 738 to the auto position shutting off fluid flow at act 908. In an automatic selection, the sensor 108 initiates a fluid flow when a user is detected in a field of view at act 906. When an activation signal is received, an electronic switch electrically connected to the sensor 108 actuates the motor 604 at act 910. Once the user is no longer detected, the motor rotates the gear train 712, cam 606, and the cam follower 608 from an active state of continuous fluid flow to an inactive state of no fluid flow at acts 912 and 914. When in an automatic state, fluid will again flow when a user is again detected in the field of view.

The above described system and method provide an easy-to-install, reliable means of flushing a hands-free fixture without requiring continuous sensor detection. While the system and method have been described in cam and gear embodiments, many other alternatives are possible. Such alternatives include automatic actuators, solenoid driven systems, and any other system that uses valves for fluid distribution.

Furthermore, the detent is not limited to override control disclosed. The detent can be an electronic detent, comprising a programmable timing device that sustains an uninterrupted fluid flow for an extended period of time. Moreover, the system can also embrace other mechanical detents, for example, that lock movement of the motor 604 or the gear train 712 and/or the shaft 732. One such embodiment can comprise a catch lever that seats within a channel of the spur gear 728 of the gear train 712. Preferably, the torque of the motor 604 and/or a manual pressure can unlock some of these embodiments.

Many other alternative embodiments are also possible. For example, the mixing valve shown in FIGS. 4–6 can comprise an above surface or an above-deck element that provides easily accessible hot and cold adjustments which allows users to adjust or preset the temperature of the water being dispensed from the spout. In an alternative embodiment, the hand-free fixture can include a scalding prevention device, such as a thermostatic control that limits water temperature and/or a pressure balancing system that maintains constant water temperature no matter what other water loads are in use. Preferably, the non-scalding device and pressure balancing systems are interfaced to and control the mixing valve 602 and are unaffected by water pressure variations.

In yet another alternative embodiment, the limits of travel of the pilot 614 can be defined by the contacts between the override arm 724 and the convex surfaces of the strike plate 730. At one end of this embodiment, the override arm 724 strikes a positive moderate sloping side surface 734 of the strike plate 730 and at another end the override arm 724 strikes a substantially linear side surface 736. In another alternative, pilot 614 movement causes the pilot supply air 804 shown in figure 8 to be vented to the atmosphere which unseats the diaphragm 610 allowing fluid to flow from the inlet to the outlet port 618 and 620. In this embodiment, the fluid which comprises a substance that moves freely but has a tendency to assume the shape of its container will flow continuously until the venting is closed. Once the vent is closed, a backpressure builds up on the diaphragm 610 closing the outlet port 620.

Installation of the hands-free embodiments can be done above or below a sink deck or surface. While the complexity of the installation can vary, the above-described embodiments can use few pre-assembled parts to connect the outlet port 620 to an output accessory. For example, a valve pin seated within a keyway can provide a seal between the valve housing and the output accessory. An O-ring can also be used to provide a positive fluid tight seal between the valve housing and accessory.

While some presently preferred embodiments of the invention have been described, it should be apparent that many more embodiments and implementations are possible and are within the scope of this invention. It is intended that the foregoing detailed description be regarded as illustrative rather than limiting, and that it be understood that it is the following claims, including all equivalents, that are intended to define the spirit and scope of this invention.

What is claimed is:

1. A hands-free, comprising:

a sensor;

a motor;

a pilot valve;

a gear train operatively connecting said motor to said pilot valve, wherein said motor opens said pilot valve when an activation signal is received from the sensor an arm operatively coupled to the gear train, said arm being configured to lock and unlock said pilot valve to allow fluid to flow continuously beyond a predetermined period of time; and an override control operatively coupled to said arm, wherein said override control is capable moving said arm between said locked and unlocked configurations.

2. The hands-free faucet of claim 1, wherein the sensor comprises a proximity sensor.

3. The hands-free faucet of claim 1, wherein said motor operates on a direct current.

4. The hands-free faucet of claim 1, wherein the gear train comprises a spur gear having a stem coupled to an outer surface that limits the travel of the pilot.

5. The hands-free faucet of claim 4, wherein the limits of travel of the pilot are established in part by side surfaces of a strike plate.

6. The hands-free faucet of claim 1, further comprising a mixing valve coupled to the pilot valve.

7. The hands-free faucet of claim 1, further comprising a diaphragm coupled to the pilot valve and in contact with a volume of fluid on a portion of an inlet and an outlet surface.

8. A proximity faucet, comprising:

a sensor;

a pilot valve assembly that dispenses fluids when an activation signal is received from the sensor, the pilot valve assembly comprising a Direct Current motor;

an arm coupled to the pilot valve assembly, said arm being configured to prevent or allow movement of a diaphragm positioned below the pilot valve assembly; and an override control operatively coupled to said arm, wherein said override control is capable of moving said arm to prevent or allow movement of said diaphragm;

wherein said Direct Current motor is coupled to a shaft, coupled to a cam, coupled to a cam follower, coupled to a gear train and wherein the cam follower has a P-shaped cross-section and wherein the cam is disposed within an orifice passing through the cam follower.

9. The proximity faucet of claim 8, further comprising a mixing valve that dispenses fluids to a preset or an adjustable temperature.

* * * * *